US008413352B2

(12) United States Patent
Watkins

(10) Patent No.: US 8,413,352 B2
(45) Date of Patent: Apr. 9, 2013

(54) CLUB HEAD CLEANING ATTACHMENT FOR A GOLF SHOE

(76) Inventor: Robert A. Watkins, Manassas, VA (US)

( * ) Notice: Subject to any disclaimer, the term of this patent is extended or adjusted under 35 U.S.C. 154(b) by 427 days.

(21) Appl. No.: 12/846,579

(22) Filed: Jul. 29, 2010

(65) Prior Publication Data

US 2011/0078926 A1 Apr. 7, 2011

Related U.S. Application Data

(60) Provisional application No. 61/272,558, filed on Oct. 6, 2009.

(51) Int. Cl.
*A43B 5/00* (2006.01)

(52) U.S. Cl.
USPC ..... 36/127; 36/132; 36/7.2; 15/227

(58) Field of Classification Search ..... 36/127, 36/132, 133, 136, 7.2, 72 R; 15/227
See application file for complete search history.

(56) References Cited

U.S. PATENT DOCUMENTS 2,292,770 A * 8/1942 Platkin ..... 36/7.2
3,526,014 A 9/1970 Edwards
3,526,917 A * 9/1970 Haywood, Jr. ..... 15/104.93
3,699,672 A 10/1972 Sims
3,851,410 A * 12/1974 Frazier ..... 36/133
4,122,577 A * 10/1978 Catania ..... 15/160
4,912,800 A 4/1990 Zeltner
4,924,608 A 5/1990 Mogonye
4,940,349 A 7/1990 Jansen van Rensburg
5,173,985 A * 12/1992 Palmer ..... 15/227
5,203,048 A 4/1993 Bynum
5,230,117 A 7/1993 Johnson et al.
D350,232 S 9/1994 Stangarone et al.
5,471,767 A * 12/1995 Walker ..... 36/2.6
5,472,200 A * 12/1995 Miller ..... 473/217
D376,880 S 12/1996 Liebscher
4,912,800 B1 1/1997 Zeltner
5,809,669 A 9/1998 Hage et al.
5,930,920 A * 8/1999 Arnold ..... 36/132
5,979,008 A 11/1999 Gordon
6,003,190 A 12/1999 Knudsen
6,393,648 B1 5/2002 Reynolds
(Continued)

OTHER PUBLICATIONS

Website, http://www.exsitegolf.com/, practice/tee brush, three sheets printed from the internet on Aug. 13, 2009.
Website, http://www.golf4u.com.au/index.php?option=com_content&view=article&id=9&Itemid=3, Brisole golf shoes, three sheets printed from the Internet on Aug. 13, 2009.

*Primary Examiner* — Marie Patterson
(74) *Attorney, Agent, or Firm* — Richard C. Litman

(57) ABSTRACT

The club head cleaning attachment for a golf shoe is removably secured to a golf shoe to enable the shoe to be used in cleaning the head or face of a golf club during play. The device is formed of a flexible, resilient elastomeric material, and has a toe pocket fitting over the extreme forward end of the toe cap and sole of the shoe. Attachment straps or bands extend rearwardly to secure the device about the horizontal circumference of the shoe. The strap or band may be a continuous, endless component stretched to fit around the shoe, or may have mating first and second ends that secure to one another behind the heel. The toe pocket includes a cleaning element extending outwardly therefrom generally along the forward edge of the shoe sole. The cleaning element may be a non-woven web of plastic material, an absorbent cloth, or a brush.

15 Claims, 4 Drawing Sheets

U.S. PATENT DOCUMENTS

| | | | | |
|---|---|---|---|---|
| 6,732,397 | B2 * | 5/2004 | Thompson | 15/160 |
| 6,981,340 | B2 * | 1/2006 | Evans | 36/7.2 |
| D533,323 | S | 12/2006 | Donovan et al. | |
| 7,313,842 | B1 * | 1/2008 | Preciado | 15/227 |
| 2003/0131500 | A1 | 7/2003 | Kline et al. | |
| 2003/0192198 | A1 * | 10/2003 | Wright et al. | 36/7.7 |
| 2003/0208869 | A1 | 11/2003 | Thompson | |
| 2003/0208932 | A1 | 11/2003 | Thompson | |
| 2004/0237350 | A1 | 12/2004 | Latham et al. | |
| 2006/0283049 | A1 | 12/2006 | Huseby | |
| 2009/0119857 | A1 | 5/2009 | Yurman et al. | |

* cited by examiner

CLUB HEAD CLEANING ATTACHMENT FOR A GOLF SHOE

CROSS-REFERENCE TO RELATED APPLICATION

This application claims the benefit of U.S. Provisional Patent Application Ser. No. 61/272,558, filed Oct. 6, 2009.

BACKGROUND OF THE INVENTION

1. Field of the Invention

The present invention relates to golfing accessories, and particularly to a club head cleaning attachment for a golf shoe that enables a golfer to clean the face of a golf club without changing his or her stance.

2. Description of the Related Art

In the game of golf, contact of the club head with the underlying surface occurs more often than not. This is especially true with iron shots after the initial tee shot, but may even occur with some tee shots as well. Accordingly, the club head picks up soil, sand, grass, mud, etc., particularly when used to hit a ball resting directly upon the underlying surface.

Most golfers recognize that such contamination or residue remaining on a club head, and particularly on the face of the club as it contacts the ball, will have at least some adverse effect on the path or flight of the ball. Oftentimes the grooves in the club face will become filled with grass, dirt or mud, thus limiting the ability of the grooves to engage the surface of the ball at impact the next time the club is used. This can negatively affect the spin imparted to the ball, thereby affecting its flight path.

An example occurs when a "short" club is used with the intent to impart backspin to the ball to shorten its roll after landing. If the club face is contaminated with grass, moisture, and/or other debris from a previous shot, the ball will slip against the club face as the face impacts the ball, with the club failing to impart the desired backspin to the ball. The result is that the ball instead rolls well past its intended stopping point due to the lack of backspin. This can make a very large difference in the total distance traveled by the ball, particularly when a relatively short flight is intended by the use of a high loft club. Considerable variation in the lateral flight of the ball may also occur when a club with a contaminated face is used to strike the ball.

Accordingly, nearly all golfers will carry some means for cleaning at least the faces of the heads of their golf clubs during a round of golf. While many specialized devices have been made for cleaning the faces and heads of golf clubs, most are adapted to remain with the golf bag or perhaps on the golf cart during a round of play. This clearly results in additional time and effort expended by the golfer as he or she walks back and forth between the lie of the ball and the location of his or her golf bag or cart. While golf is intended to provide mild exercise and the additional walking may be of no great consequence, the additional time expended can slow the play of the game to some degree. This can be critical when another party is approaching or when playing time is limited for whatever reason.

As a result, many golfers will carry a towel or other cleaning device with them as they play. This does reduce or eliminate the delay factor that occurs when the club head cleaning device is located away from the lie of the ball in play. However, while some such devices are relatively unobtrusive, others (e.g., relatively large towels, devices suspended from the belt or other article of clothing, etc.) may create a distraction to the golfer and impede his or her play. In such instances, the solution may be worse than the problem.

Thus, a club head cleaning attachment for a golf shoe solving the aforementioned problems is desired.

SUMMARY OF THE INVENTION

The club head cleaning attachment for a golf shoe essentially comprises a flexible and resilient elastomeric strap or band having a shallow, concave toe pocket therein. The toe pocket is secured over the forwardmost end or toe cap of the golf shoe. The strap portion extends back along the sides of the shoe and around the heel. The shallow toe pocket provides sufficient edge-to-edge width to fit over the forwardmost portion of the toe cap and leading edge of the sole of the shoe without extending farther to the rear, thus keeping open the area rearward of the toes both across the shoe top and the sole to assure that the cleats or spikes extending from the sole are not compromised. The toe pocket includes a club head cleaning element extending outwardly therefrom and generally having a height not substantially thicker than the sole of the shoe. The cleaning element may comprise a non-woven web of plastic material (e.g., Scotch-Brite®, an absorbent cloth (e.g., terrycloth material), or a bristled brush extending outwardly from the exterior surface of the pocket. Cleaning elements formed of other materials may also be provided.

The strap or band used to secure the device to the shoe may comprise a continuous elastomeric band that is secured to the shoe by stretching it around the horizontal circumference of the shoe. A tab may extend from the rearward portion of the strap to assist the user in applying the device to the shoe and in removing the device from the shoe. Alternatively, the strap or band may have mating first and second ends, one end comprising an open loop or clasp and the other end comprising adjacent portions of mating hook and loop fabric material (e.g., Velcro®). The strap end with the hook and loop material is passed through the open loop or clasp and doubled back to secure upon itself, thus securing the device to the shoe. Other fasteners for securing the two ends of the straps to one another may be used instead. Additional security may be attained by providing the internal surface of the strap or band, i.e., the surface in contact with the shoe when the device is secured on the shoe, with a coating having a high coefficient of friction.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises various embodiments of a club head cleaning attachment for a golf shoe, the attachment being removably secured about the shoe. The attachment includes a cleaning element (brush, etc.) extending therefrom for wiping the head or face of a golf club thereon in order to clean the club head of grass, dirt, sand, mud, and/or other debris adhering to the club head and face after making a previous shot. Various types of cleaning elements or materials may be provided, as well as different means of removably attaching the device to a golf shoe, as described below.

Figure 1:
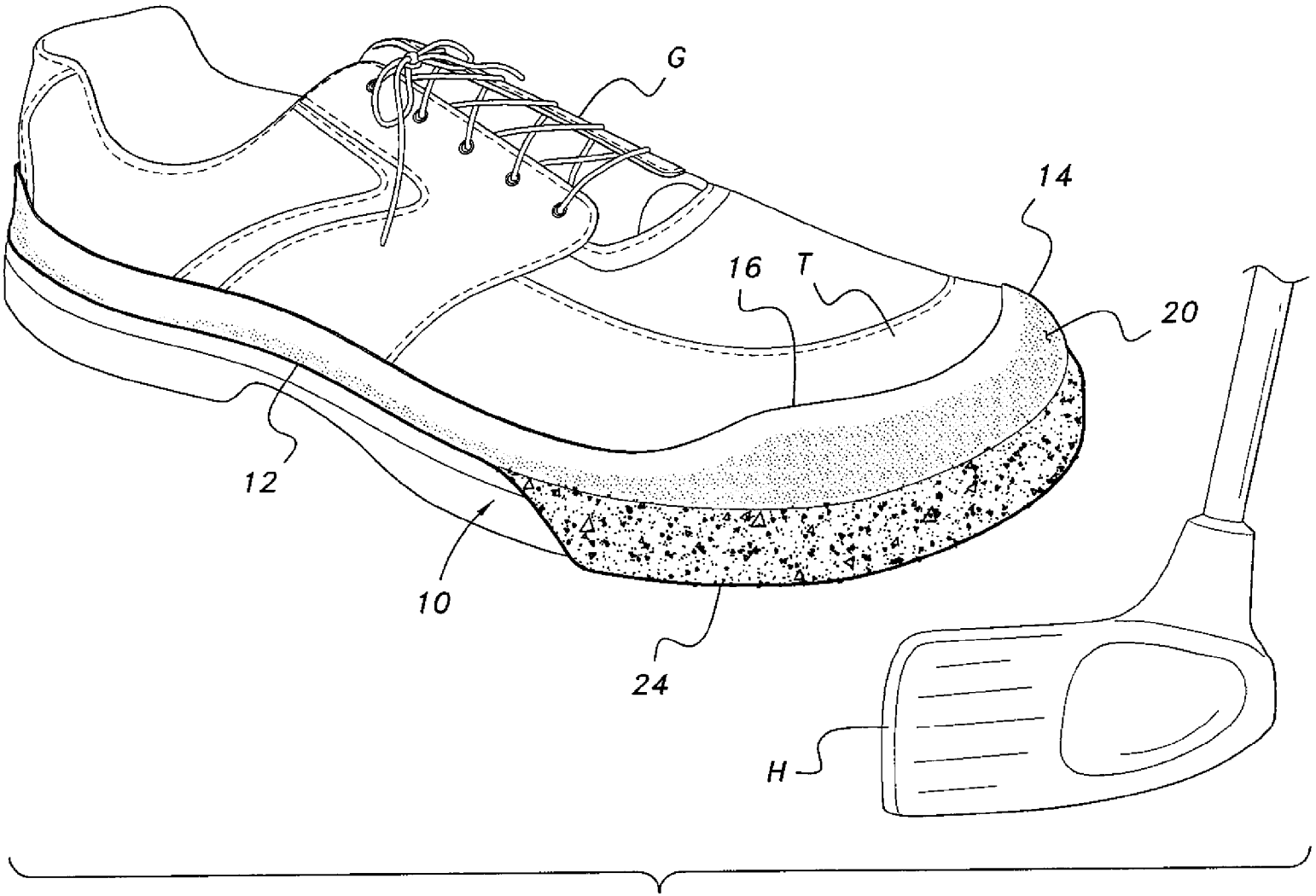
FIG. 1 is an environmental, perspective view of a first embodiment of a club head cleaning attachment for a golf shoe according to the present invention, showing its attachment to a golf shoe and its general use.
Figure 2:
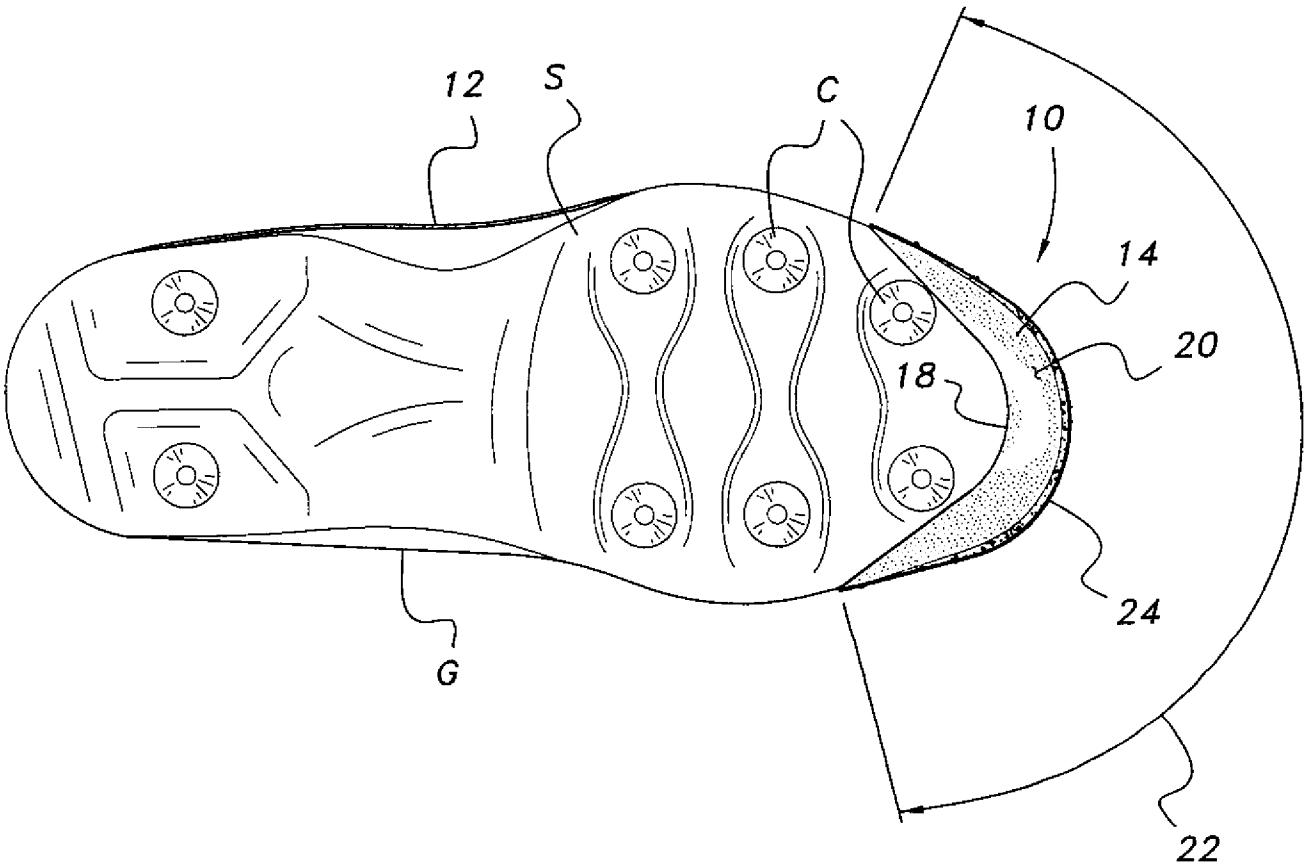
FIG. 2 is a bottom plan view of the club head cleaning attachment of FIG. 1 shown secured to a golf shoe, thus showing the clearance provided for the spikes or cleats extending from the sole of the shoe.

FIGS. 1 and 2 of the drawings illustrate a first embodiment of the club head cleaning attachment 10, wherein the attachment includes an endless band 12 that stretches to attach removably around the shoe. The club head cleaning attachment 10 has an endless band 12 or closed loop of flexible, resilient, elastomeric material (e.g., spandex, natural or synthetic rubber, etc.) having a having a concave toe pocket 14 formed integrally therewith. The toe pocket 14 is relatively shallow and has a height (from top to bottom, when applied to the shoe) not excessively greater than the width of the band 12 extending from the pocket 14, or just sufficient to assure that the toe pocket 14 cannot readily slip either above or below the forwardmost portion or toe of the shoe and its sole. Thus, the upper and lower edges 16 and 18 of the toe pocket 14 do not extend rearwardly much beyond the forwardmost portion of the shoe upper or toe cap T of the golf shoe G and the forwardmost portion of the shoe sole S. In this manner the toe pocket 14 remains clear of the spikes or cleats C extending from the sole S of the golf shoe G as shown in FIG. 2, in order that the cleats C remain exposed for proper function.

The toe pocket 14 is formed of a relatively thin elastomeric material of substantially uniform thickness, and thus has a convex external surface 20 closely paralleling its concave inner surface and the convex forward portion of the golf shoe G. The toe pocket 14 has a length 22, i.e., its semicircumferential dimensional extent along the length of the band or strap 12, considerably less than the length of the band 12, extending around the toe to points approximately even with or slightly forward of the maximum width of the shoe G on each side, as shown in FIG. 2.

A golf club head cleaning element 24 extends outwardly or faces outwardly from the external surface 20 of the toe pocket 14, extending substantially the entire length 22 of the toe pocket. The height of the cleaning element 24, i.e., its extent between the upper and lower edges 16 and 18 of the toe pocket 14, is considerably less than the height of the toe pocket 14, preferably being somewhat less than half the height of the toe pocket 14. This is sufficient to position the cleaning element 24 directly along the forwardmost protruding edge of the shoe sole S, immediately below the toe cap of the golf shoe G. In this manner, the cleaning element 24 protrudes from the forwardmost portion of the golf shoe G, allowing an article (e.g., the golf club head H shown in FIG. 1) to be cleaned, brushed or wiped off merely by rubbing or wiping the article against the toe of the shoe and the exposed cleaning element 24. The club head cleaning element 24 may be formed of a wide variety of materials, as desired. In the exemplary club head cleaning attachment 10 of FIGS. 1 and 2, the club head cleaning element 24 is formed of a non-woven web of plastic fibers, e.g., Scotch-Brite® or the like. Such relatively coarse or open materials permit most of the dirt, sand, and debris to fall from the cleaning element onto the ground, rather than becoming embedded in the cleaning material and rapidly soiling the material to the point that it is no longer effective.

Figure 3:
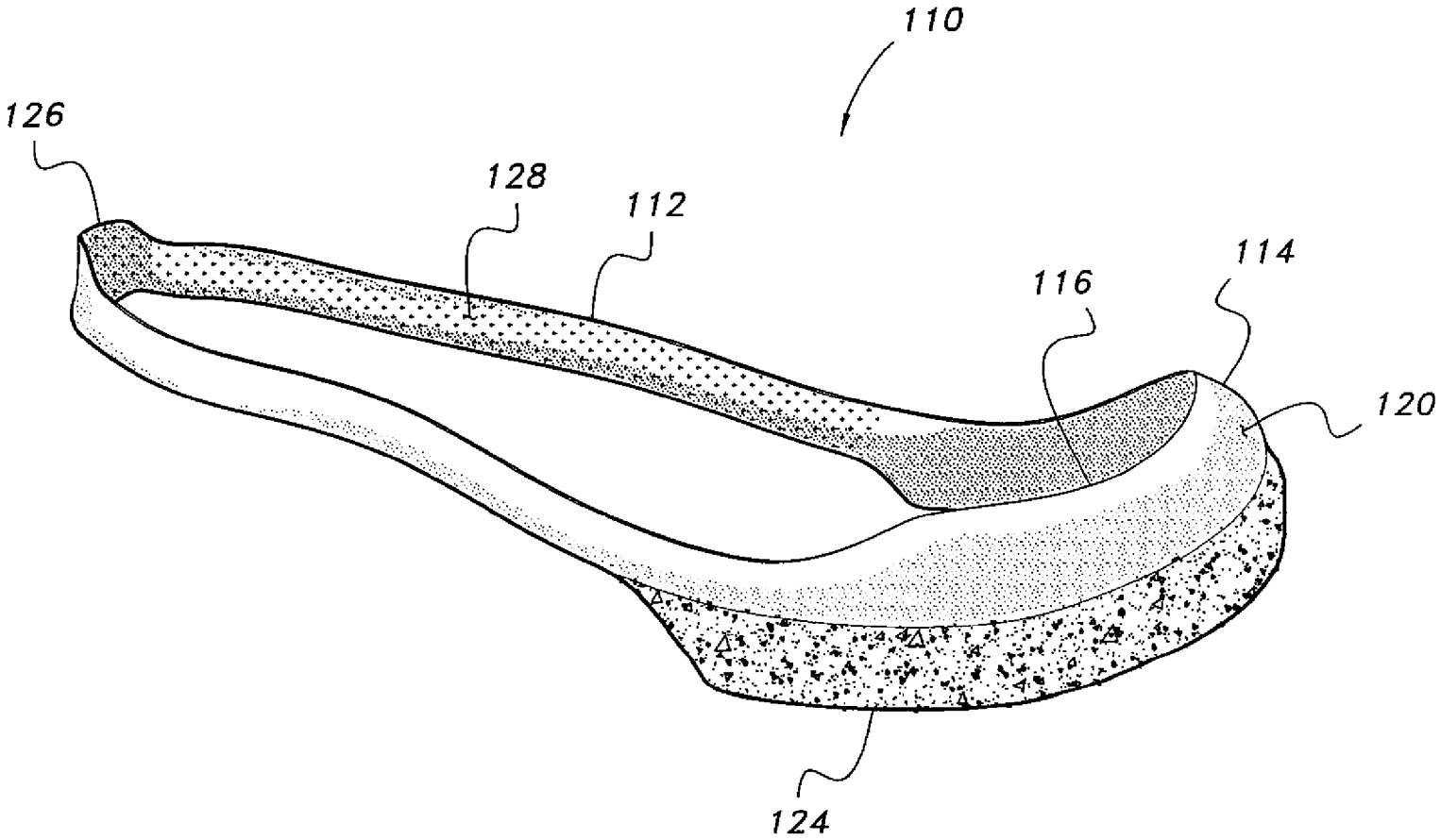
FIG. 3 is a perspective view of a second embodiment of a club head cleaning attachment for a golf shoe according to the present invention, illustrating various features thereof.

The club head cleaning attachment 110 of FIG. 3 is similar to the attachment 10 of FIGS. 1 and 2, except that for the material from which the cleaning element 124 is manufactured. In the example of FIG. 3, the cleaning element 124 comprises an absorbent towel-like cloth material, e.g., terrycloth or the like. Other components and features of the attachment 110 of FIG. 3 are identical to corresponding components of the attachment 10 of FIGS. 1 and 2. Features and components of the club head cleaning attachment 110 that correspond directly to those features and components of the club head cleaning attachment 10 of FIGS. 1 and 2 are designated by corresponding reference numerals, with the reference numerals of the embodiment 110 differing only in that they are three digit numbers beginning with a one.

The stretchable elastomeric material of which the bands 12 (FIGS. 1 and 2) and 112 (FIG. 3) and their toe pockets 14, 114 are formed allows the club head cleaning attachment 10 or 110 to be stretched for installation circumferentially and generally horizontally about the lower portion of the golf shoe G, generally as shown in FIG. 1 of the drawings. Accordingly, a pull tab is provided, e.g., the pull tab 126 shown in FIG. 3, that extends laterally (i.e., coplanar with) from the band or strap 12 (or 112, in FIG. 3) and is disposed generally opposite the toe pocket 14 (or 114) to facilitate applying the cleaning attachment 10 (or 110) to a golf shoe G, or for removing the attachment from the golf shoe.

Both the band 12 (FIGS. 1 and 2) or 112 (FIG. 3) and its toe pocket 14 or 114 may be formed of a variety of materials, so long as those materials are flexible, resilient, and stretch to provide a secure installation on the shoe. Spandex and natural and synthetic rubber materials have been noted above as being suitable. The material used may or may not have a surface providing a good grip of the underlying material, i.e., having a high coefficient of friction. For example, spandex provides sufficient elastic properties for use in forming the attachment 10, 110, but is not particularly noted for its surface coefficient of friction. Accordingly, the inner surface 128 of the band 112 and its toe pocket 114, i.e., the shoe contact surface, may be coated with a relatively soft natural or synthetic rubber compound or other suitable material having a high coefficient of friction in order to minimize slippage of the band 112 and toe pocket 114 on the golf shoe G, as shown in the club head cleaning attachment embodiment 110 of FIG. 3 of the drawings. The same or similar coating may be applied to the inner or shoe contact surface of the band 12 of the attachment 10 of FIGS. 1 and 2, as desired.

Figure 4:
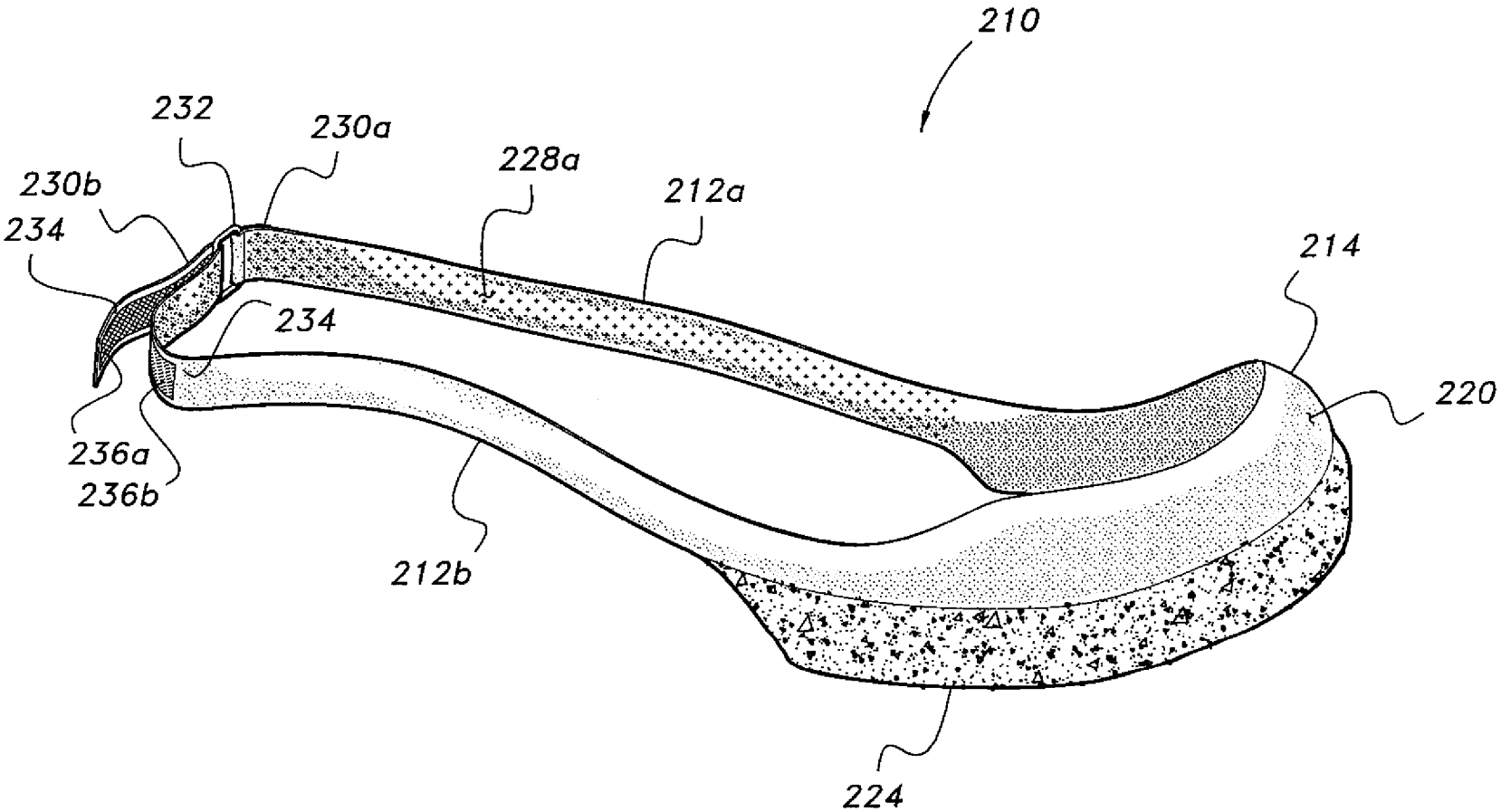
FIG. 4 is a perspective view of a third embodiment of a club head cleaning attachment for a golf shoe according to the present invention, illustrating various features thereof.

FIG. 4 of the drawings illustrates a somewhat different embodiment of the club head cleaning attachment, designated as attachment 210. The primary difference between the club head cleaning attachments 10 and 110 of FIGS. 1 through 3 and the attachment 210 of FIG. 4 is that the band of the attachment 210 is broken at a point about opposite the toe pocket 214, i.e., the band comprises first and second portions 212*a* and 212*b* having corresponding first and second ends 230*a* and 230*b*. The two band portions 212*a*, 212*b* may be coated on their inner or shoe contact surfaces, e.g., surface 228*a*, with a non-slip coating similar or identical to the coating used on the surface 128 of the band 112 of the attachment 110 of FIG. 2.

In the example of FIG. 4, the first end 230*a* has a rigid loop 232 (metal, etc.) attached thereto, while the opposite second end 230*b* has an outer surface 234 with a first strip or patch of hook and loop fastener material 236*a* disposed upon the most distal portion thereof, and a second mating strip or patch of hook and loop fastener material 236*b* disposed on the outer surface 234 adjacent to the first material 236*a*. Thus, the end 230*b* of the second band portion 212*b* is passed through the loop 232 at the end 230*a* of the first band portion 212*a* and doubled back upon itself so the mating fastener materials 234*a* and 234*b* adhere removably to one another. Alternative means of connecting the two band ends to one another may be provided, if desired, e.g., mating snap fasteners, mating buckle members extending from the ends, etc., if desired.

Other than the band configuration and the material used for the cleaning element 224, the attachment 210 is substantially the same as the attachment 10 of FIGS. 1 through 3, the toe pocket 214 having substantially the same configuration with its cleaning element 224 extending forwardly therefrom or thereon, etc. In the case of the club head cleaning attachment 210 of FIG. 4, a bristled brush is provided for the cleaning element 224 extending from the toe pocket 214. It will be understood that other alternative materials may be provided for the cleaning elements, if desired. Moreover the various cleaning elements 24, 124, and 224 are not limited to the respective club head cleaning attachment embodiments 10, 110, and 210 described herein, but may be interchangeably applied to any of the embodiments, as desired.

The golf club head cleaning attachment in any of its embodiments 10, 110, or 210 is used by removably installing the device upon a golf shoe G, generally as shown in FIGS. 1 and 2 of the drawings. As the attachment is formed of very flexible and resilient material, it may be applied to either the left shoe or to the right shoe, or one may be applied to each shoe, if desired. When a golf club head has picked up dirt, grass, mud, and/or other contamination from the ground during a swing, the golfer need only wipe the club face and other contaminated portions of the club head H on the club head cleaning element 24, 124, or 224, depending upon the specific embodiment of the golf club head cleaning attachment being worn. The configurations of the cleaning elements, and particularly those elements 24 and 224 respectively comprising non-woven plastic fiber material and a bristled brush, result in the debris removed from the club face or other areas of the head mostly falling from the cleaning element. These types of cleaning elements do not tend to absorb the dirt and grime removed from the club face and head.

The club head cleaning attachment 24, 124, or 224 enables the golfer to clean his or her club head on the spot without needing to walk back to the golf cart or golf bag, which may be located some distance away from the lie of the ball. In fact the attachment allows a golfer to perform some cleaning of the club head while addressing the ball, without the need to adjust his or her stance appreciably. This saving of time will be much appreciated by golfers during a round of play, including golfers in subsequent groups, as they are not delayed by undue delays on the part of a golfer needing to walk back and forth to some other location to clean his or her equipment. When the round of golf has been completed, the player may remove the attachment(s) 10, 110, or 210 from his or her golf shoe(s) and wash or rinse out the respective club head cleaning element 24, 124, or 224, thus readying the device for the next round of golf.

It is to be understood that the present invention is not limited to the embodiments described above, but encompasses any and all embodiments within the scope of the following claims.

I claim:

1. A club head cleaning attachment for a golf shoe, consisting of:

a flexible, resilient elastomeric band adapted for being removably secured circumferentially and generally horizontally about a golf shoe, the band having a first end and a second end opposite the first end, the band having a shoe contact surface and a shallow, concave toe pocket formed integrally therewith and defining the second end, the toe pocket having a convex external surface, a height defined by the upper and lower edges of the pocket, and a peripheral length coextensive with the concave toe pocket, wherein the toe pocket is sized and configured to correspond to the toe portion only of a golf shoe thereby being clear of the sole and spikes extending from the sole of a golf shoe; and a golf club head cleaning element disposed on the external surface of the toe pocket, the cleaning element extending coextensively along the peripheral length of the toe pocket, wherein the height of the cleaning element does not exceed half the height of the toe pocket.

2. The club head cleaning attachment for a golf shoe according to claim 1, wherein:

the first end of the band includes free first and second end portions, the first end potion has a loop attached thereto and extending therefrom; and the second end portion has an external surface having mating first and second hook and loop fastener materials disposed therealong, the second end portion passing through the loop of the first end portion and doubling back to fasten the mating first and second hook and loop fastener materials together for removably securing the first end portion and the second end portion to one another.

3. The club head cleaning attachment for a golf shoe according to claim 1, wherein the first end of the band the first end of the band includes free first and second end portions, the first end potion and the second end portion of the band have mutually mating first and second snap members disposed respectively thereon.

4. The club head cleaning attachment for a golf shoe according to claim 1, wherein the first end of the band the first end of the band includes free first and second end portions, the first end potion and the second end portion of the band have mutually mating first and second buckle members disposed respectively thereon.

5. The club head cleaning attachment for a golf shoe according to claim 1, wherein the cleaning element is a non-woven web of plastic fibers.

6. The club head cleaning attachment for a golf shoe according to claim 1, wherein the cleaning element is an absorbent cloth.

7. The club head cleaning attachment for a golf shoe according to claim 1, wherein the cleaning element is a brush.

8. The club head cleaning attachment for a golf shoe according to claim 1, wherein the band and the toe pocket are formed of materials selected from the group consisting of spandex, natural rubber, and synthetic rubber.

9. The club head cleaning attachment for a golf shoe according to claim 1, wherein the shoe contact surface of the band is coated with a gripping agent having a high coefficient of friction.

10. A club head cleaning attachment for a golf shoe, comprising:

a flexible, resilient elastomeric band adapted for being removably secured circumferentially and generally horizontally about a golf shoe, the band having a first end and a second end opposite the first end, the band having a shoe contact surface and a shallow, concave toe pocket formed integrally therewith and defining the second end, the toe pocket having a substantially continuous convex external surface wherein the medial portion of the convex external surface defines a toe portion, a height defined by the upper and lower edges of the pocket, and a peripheral length coextensive with the concave toe pocket, wherein the toe pocket is sized and configured to correspond to the toe portion only of a golf shoe thereby being clear of the sole and spikes extending from the sole of a golf shoe; and a golf club head cleaning element disposed on the external surface of the toe pocket, the cleaning element extending at least along the peripheral length of the toe portion of the toe pocket.

11. The club head cleaning attachment for a golf shoe according to claim 10, wherein the first end of the band includes free first and second end portions, each of the free ends include mutually engageable portions for removably securing the first end portion and the second end portion to one another.

12. The club head cleaning attachment for a golf shoe according to claim 10, wherein the first end of the band comprises an endless band.

13. A club head cleaning attachment for a golf shoe, consisting of:

a flexible band adapted for being removably secured circumferentially and generally horizontally about a golf shoe, the band having a first end and a second end opposite the first end, the band having a shoe contact surface and a shallow, concave toe pocket formed integrally therewith and defining the second end, the toe pocket having a substantially continuous convex external surface wherein the medial portion of the convex external surface defines a toe portion, a height defined by the upper and lower edges of the pocket, and a peripheral length coextensive with the concave toe pocket, wherein the toe pocket is sized and configured to correspond to the toe portion only of a golf shoe thereby being clear of the sole and spikes extending from the sole of a golf shoe; and a golf club head cleaning element disposed on the external surface of the toe pocket, the cleaning element extending at least along the peripheral length of the toe portion of the toe pocket, wherein the height of the cleaning element does not exceed half the height of the toe pocket.

14. The club head cleaning attachment for a golf shoe according to claim 13, wherein the first end of the band comprises an endless band.

15. The club head cleaning attachment for a golf shoe according to claim 13, wherein the first end of the band includes free first and second end portions, each of the free ends include mutually engageable portions for removably securing the first end portion and the second end portion to one another.

* * * * *